US011634941B2

(12) United States Patent
Tenzon

(10) Patent No.: US 11,634,941 B2
(45) Date of Patent: Apr. 25, 2023

(54) WINDOW/SHUTTER/DOOR FOR OUTDOOR SETTINGS

(71) Applicant: Uniform S.P.A., Minerbe (IT)

(72) Inventor: Franco Tenzon, Minerbe (IT)

(73) Assignee: Uniform S.P.A., Minerbe (IT)

( * ) Notice: Subject to any disclaimer, the term of this patent is extended or adjusted under 35 U.S.C. 154(b) by 81 days.

(21) Appl. No.: 16/888,887

(22) Filed: Jun. 1, 2020

(65) Prior Publication Data

US 2020/0378176 A1 Dec. 3, 2020

(30) Foreign Application Priority Data

Jun. 3, 2019 (IT) ..... 102019000007914

(51) Int. Cl.
*E06B 3/36* (2006.01)
*E05D 11/10* (2006.01)
*E06B 7/23* (2006.01)

(52) U.S. Cl.
CPC ..... *E06B 3/36* (2013.01); *E05D 11/10* (2013.01); *E06B 7/2305* (2013.01); *E06B 7/2312* (2013.01); *E05Y 2900/132* (2013.01); *E05Y 2900/146* (2013.01); *E05Y 2900/148* (2013.01)

(58) Field of Classification Search
CPC ..... E06B 3/36; E06B 7/2305; E06B 7/2312; E05D 11/10; E05D 3/186
See application file for complete search history.

(56) References Cited

U.S. PATENT DOCUMENTS 2,910,154 A * 10/1959 Hammitt ..... E05D 5/0223 49/504
3,703,063 A * 11/1972 Budich ..... E06B 3/60 49/504
4,084,361 A * 4/1978 Aspaas ..... E06B 3/308 52/204.593
4,281,481 A * 8/1981 Wendt ..... E06B 5/161 49/504
4,314,424 A * 2/1982 Gordon ..... E06B 3/308 49/495.1
4,748,716 A * 6/1988 Bentz ..... E05D 11/06 16/382

(Continued)

FOREIGN PATENT DOCUMENTS

AT 275121 B 10/1969
CA 2828673 A1 * 4/2014 ..... E05D 3/02

(Continued)

*Primary Examiner* — Marcus Menezes
(74) *Attorney, Agent, or Firm* — Mark M. Friedman

(57) ABSTRACT

Window for outdoor settings, which comprises a movable wing provided with a first support frame hinged to a second support frame of a fixed framework by means of a hinging system, so that, when the movable wing is closed, the two frames define two opposite perimeter faces delimiting a slit. The window comprise a first perimeter gasket fixed to one of the two opposite perimeter faces, acting against the other perimeter face, and placed at an internal opening of the slit in order to conceal from view the hinging system of the window. The window further comprises a second perimeter gasket fixed to one of the two opposite perimeter faces, acting against the other perimeter face, and placed at an intermediate position between the internal opening and an external opening of the slit.

11 Claims, 10 Drawing Sheets

(56) References Cited

U.S. PATENT DOCUMENTS

| | | | | | |
|---|---|---|---|---|---|
| 5,117,587 | A * | 6/1992 | Doan | E06B 7/2312 | 49/495.1 |
| 2002/0059759 | A1* | 5/2002 | Bielefeld | E06B 3/221 | 52/213 |
| 2014/0069019 | A1* | 3/2014 | Back | E06B 7/22 | 49/498.1 |
| 2018/0216397 | A1* | 8/2018 | Chen | E06B 9/52 | |
| 2020/0263463 | A1* | 8/2020 | Woodward | E05C 3/043 | |

FOREIGN PATENT DOCUMENTS

| | | | | | |
|---|---|---|---|---|---|
| DE | 1659864 | A1 | | 1/1971 | |
| DE | 9112078 | U1 | * | 9/1991 | E05C 19/00 |
| DE | 29722564 | U1 | * | 3/1998 | E06B 3/62 |
| DE | 19836124 | C1 | * | 10/1999 | E06B 1/34 |
| DE | 19933099 | A1 | * | 1/2001 | E06B 3/221 |
| DE | 10125902 | A1 | | 1/2002 | |
| DE | 102006046958 | A1 | | 4/2007 | |
| DE | 102008019791 | A1 | * | 10/2009 | E06B 3/222 |
| DE | 202010003212 | U1 | * | 10/2011 | E06B 3/22 |
| DE | 202014101378 | U1 | | 4/2014 | |
| DE | 102012111005 | A1 | * | 5/2014 | E06B 3/263 |
| DE | 102016125334 | A1 | * | 6/2018 | |
| EP | 2072745 | A2 | * | 6/2009 | E06B 3/2632 |
| EP | 2195505 | B1 | | 11/2012 | |
| EP | 2811092 | A2 | | 12/2014 | |
| GB | 2334991 | A | * | 9/1999 | E06B 3/822 |
| IT | 20120133 | A1 | | 11/2013 | |
| WO | WO-2014079556 | A1 | * | 5/2014 | E06B 3/26343 |
| WO | 2018210718 | A1 | | 11/2018 | |

* cited by examiner

WINDOW/SHUTTER/DOOR FOR OUTDOOR SETTINGS

FIELD OF APPLICATION

The present invention refers to a window/shutter/door for outdoor settings, such as in particular a window or a French window/door, for closing a building wall opening.

The present window/shutter/door is generally inserted in the industrial field of production of windows/shutters/doors, in particular but not exclusively of the type provided with a wooden frame externally covered with aluminum profiles.

The window/shutter/door, object of the present invention, can be associated with the internal walling of the building with different finishes, such as by means of plaster-holder profiles, plasterboard panels, or wooden counter-frameworks and with layings which for example can be flush with the wall, or at the center of the walling, or with laying on support structure of metal framework type commonly indicated as SFS frameworks, acronym of "Steel Framing System" of which the frameworks with Metsec® trademark are commercially known.

The window/shutter/door, object of the present invention, can be associated with a single or double wing with different opening solutions and is therefore of the type generically employable for closing an opening made in a load-bearing structure of a building, being inserted as stated above in the industrial field of production of windows/shutters/doors.

STATE OF THE ART

Windows/shutters/doors have for some time been known which are of the type employable for closing openings made on load-bearing structures of buildings, for example constituted by a window or by a French window/door, provided with a fixed framework and with a movable wing mechanically connected to the fixed framework by means of hinging means.

More in detail, the fixed framework consists of two first vertical uprights and two first horizontal crosspieces rigidly fixed to the vertical uprights at the ends in order to form a frame with substantially quadrangular shape. The fixed framework is intended to be fixed to the load-bearing structure, whether this is a metallic structure or a walling, and more precisely it is intended to be fixed to the internal faces of the walls that delimit the opening with which the window/shutter/door is associated.

More in detail the movable wing is provided with a support frame around which a glass panel is perimetrically fixed, for closing the opening.

The support frame in turn comprises two vertical uprights and two horizontal crosspieces firmly connected to the two second vertical uprights in order to form the four vertices of the movable wing.

The movable wing is connected at one of its vertical uprights to an opposite vertical upright of the fixed framework by means of hinges and is movable between a closed position, in which the movable wing is placed in abutment against the fixed framework, and an open position, in which the movable wing is in angled position with respect to the fixed framework, at least partially freeing the opening defined by its support frame. The hinges can for example be of retractable type, associated at the ends of the uprights or of "knob" type, i.e. provided with two tabs connected together by a pin, one being fixed to the fixed framework and the other to the movable wing.

The window/shutter/door also comprises two or more gaskets which are mounted on the wing or on the fixed framework at opposite faces intended to face each other when the wing is in closed position.

Such gaskets are usually positioned at steps in order to allow the gaskets to be compressed when the wing is placed in closed position and to make an optimal sealing that ensures a high seal against noise and weathering agents in general, such as air and rain.

In the reference field of production of windows/shutters/doors, there is the increasing architectural need to reduce, to a minimum, the view of the frames in particular of the wings, by reducing their thickness to a minimum.

One drawback of the windows/shutters/doors of known type lies in the fact that in order to obtain a sufficient seal against noise and weathering agents it is necessary to make profiles with steps at opposite faces between framework and wing. This circumstance involves the drawback of widening the thickness of the window and of not meeting the above-mentioned architectural needs.

PRESENTATION OF THE INVENTION

In this situation, the problem underlying the present invention is therefore that of overcoming the drawbacks manifested by the solutions of known type, by providing a window/shutter/door for outdoor settings which provides a wing provided with an extremely limited thickness.

A further object of the present invention is to provide a window/shutter/door for outdoor settings which allows making a seal against noise and weathering agents.

A further object of the present invention is to provide a window/shutter/door for outdoor settings which is entirely reliable and safe in operation.

BRIEF DESCRIPTION OF THE DRAWINGS

The technical characteristics of the invention, according to the aforesaid objects, are clearly seen in the contents of the below-reported claims and the advantages thereof will be more evident in the following detailed description, made with reference to the enclosed drawings, which represent several merely exemplifying and non-limiting embodiments of the invention, in which:

DETAILED DESCRIPTION OF A PREFERRED EMBODIMENT

Figure 1:
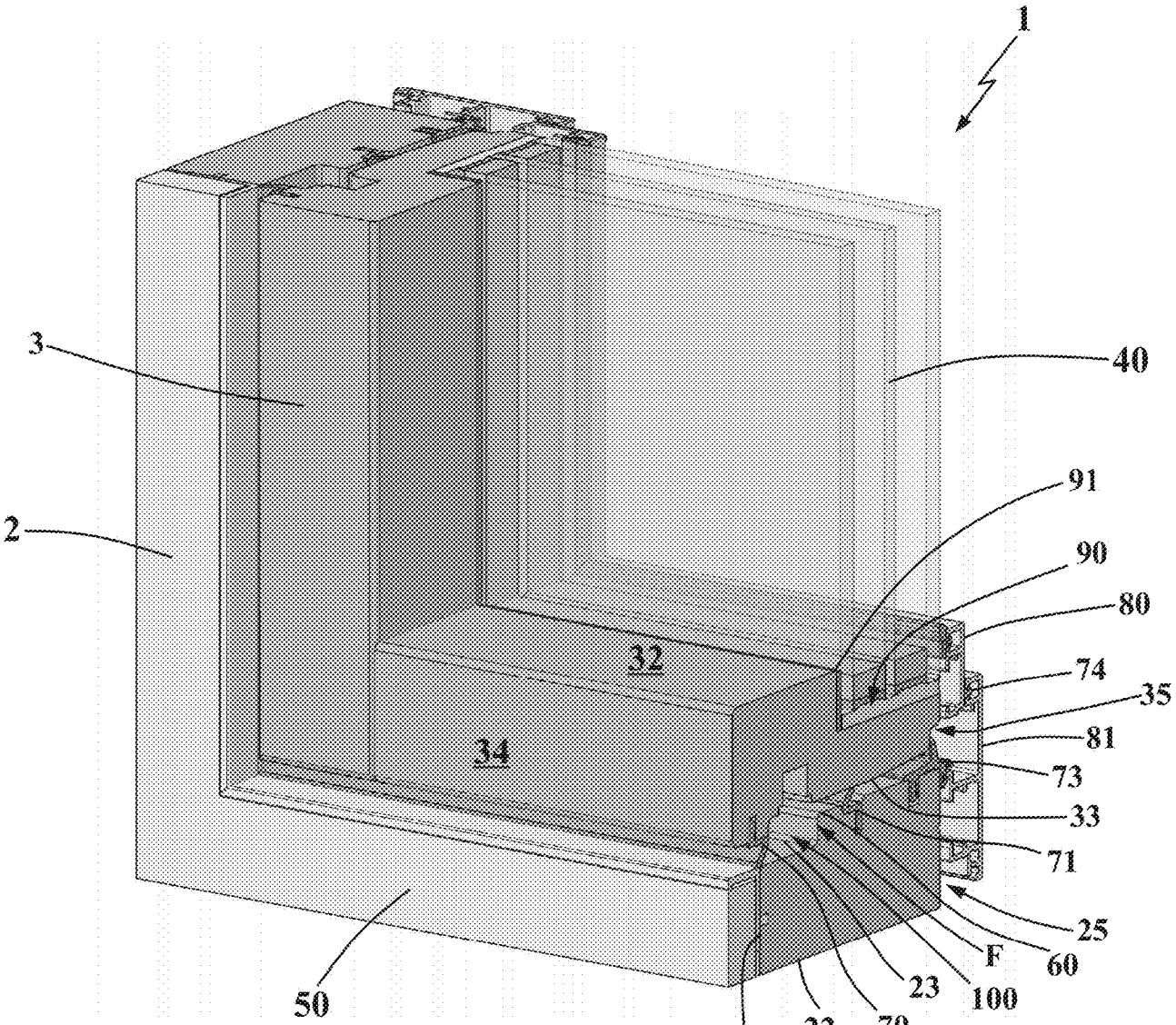
FIG. 1 shows a perspective view of an angular portion of the window/shutter/door for outdoor settings, object of the present invention, with the wing in closed position.

With reference to the enclosed drawings, reference number 1 overall indicates the window/shutter/door for outdoor settings, object of the present invention.

The window/shutter/door for outdoor settings 1, object of the present invention, is operatively employable for adjustably closing an opening S made in a load-bearing structure P of a building, for example a building wall structure. Such opening S can for example be for a window, a door or a French window/door or other similar windows/shutters/doors.

Such opening S is usually defined in the walling P of a building between two substantially vertical lateral walls, a substantially horizontal lower wall and a substantially horizontal upper wall.

Such opening S will preferably have quadrangular shape, and more in detail rectangular or square shape.

The window/shutter/door for outdoor settings 1 comprises, in a per se conventional manner, a movable wing 3 provided with a first support frame 30 and with at least one glass panel 40 (with one or more panes) perimetrically fixed to the aforesaid support frame 30, and a fixed framework 2, which supports the movable wing 3, and comprises at least one second support frame 20.

Figure 23:
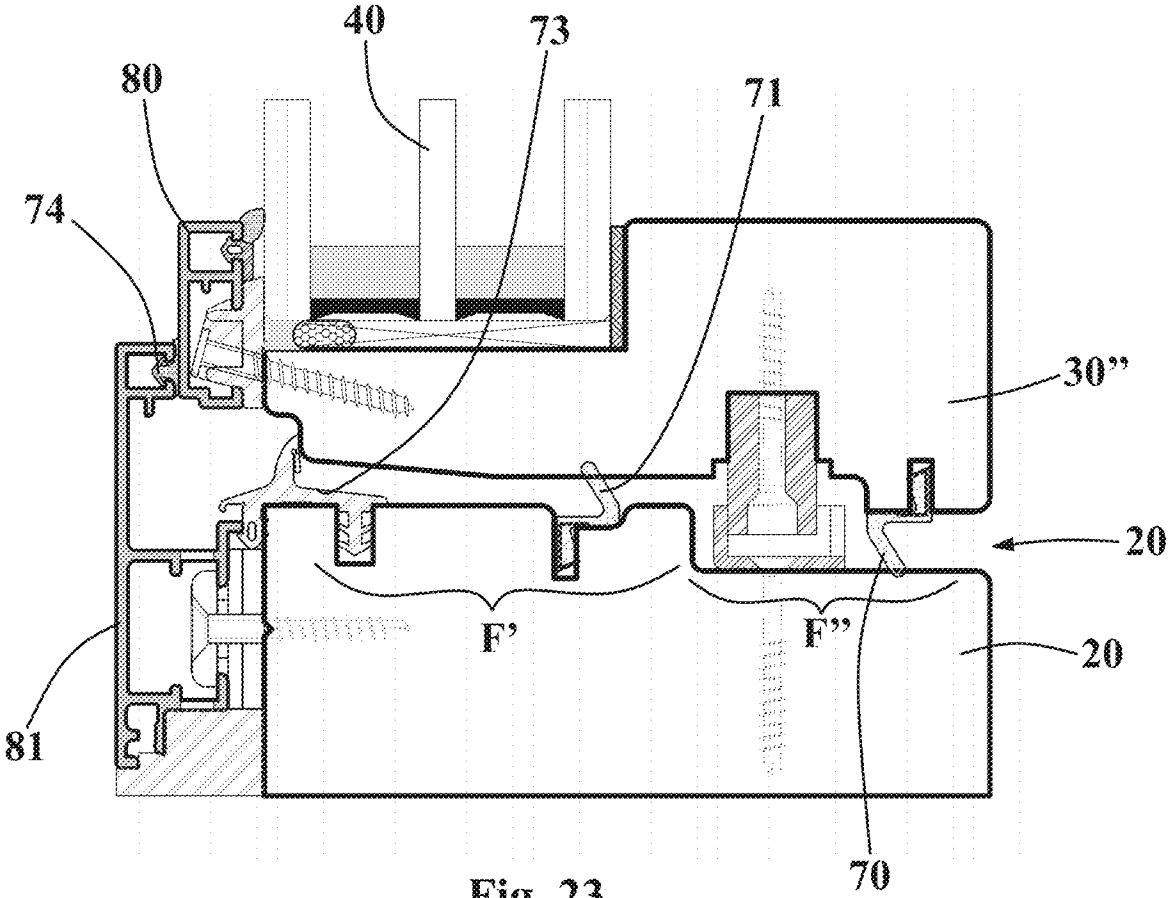
FIG. 23 shows a sectional view carried out along the trace XXII-XXII of FIG. 22, indicating the means for locking the wing to the fixed framework.
Figure 22:
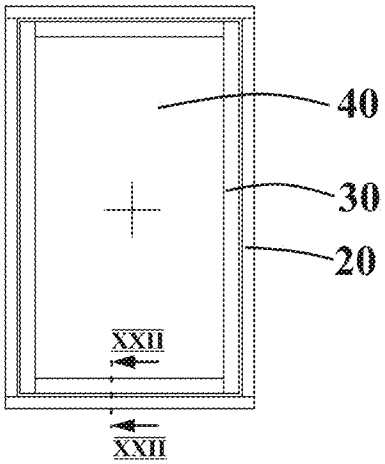
FIG. 22 shows a front schematic view of a window/shutter/door for outdoor settings, object of the present invention, comprising a fixed wing, only for the purpose of indicating the position of a section trace XXII-XXII of the crosspieces of the window/shutter/door.

The window/shutter/door for outdoor settings 1, object of the present invention, can be advantageously employed for making a single wing or double wings, for windows and French window/doors or for similar windows/shutters/doors of the type for example with a fixed wing and a movable wing, or it can also allow making movable wings 3 rendered fixed and mounted on a fixed framework 2 by prearranging on the wing 3 suitable means 110 for locking to the fixed framework 2 (see FIGS. 22 and 23).

Figure 15:
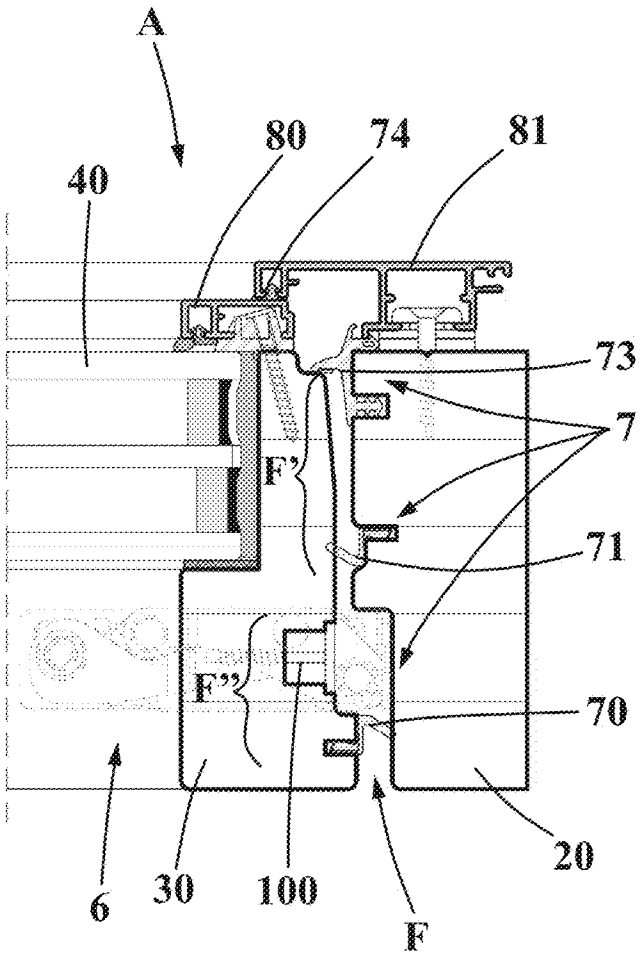
FIG. 15 shows the same view as FIG. 14 with the movable wing in closed position.
Figure 14:
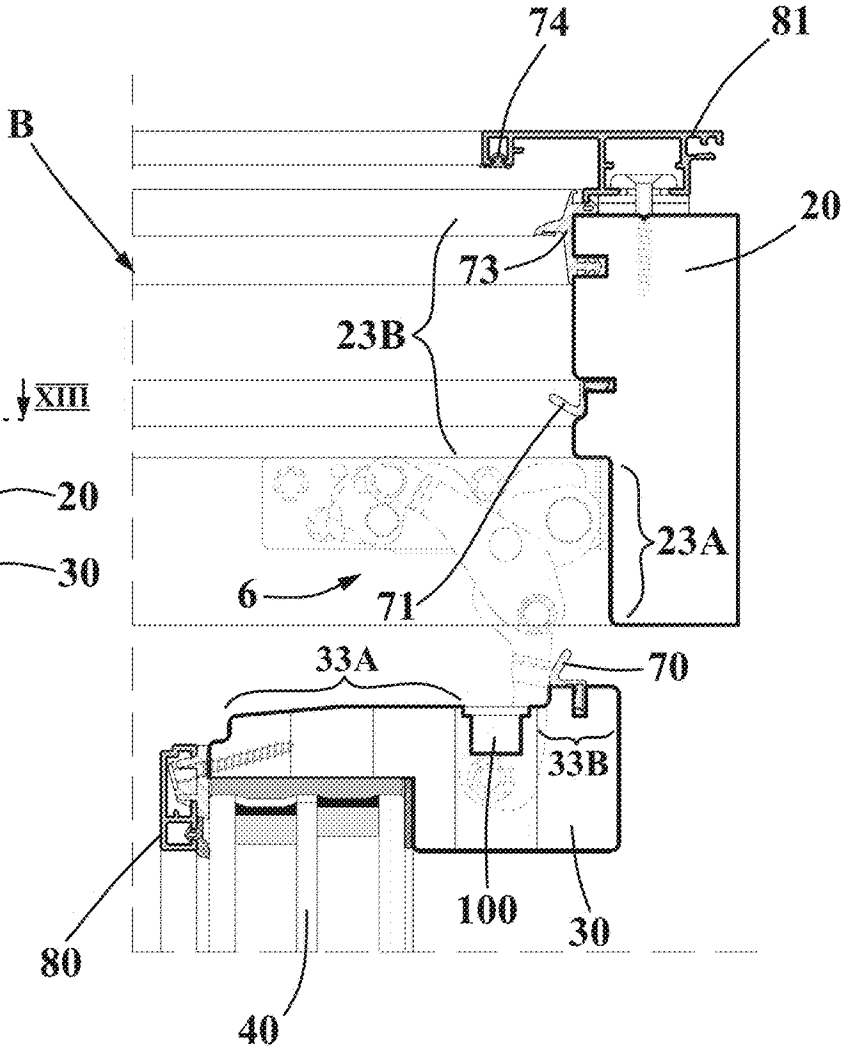
FIG. 14 shows a sectional view carried out along the trace XIII-XIII of FIG. 13, of an upright of the fixed framework and of an upright of the movable wing associated with a hinging system of the window/shutter/door for outdoor settings according to the present invention, with the movable wing in open position.
Figure 13:
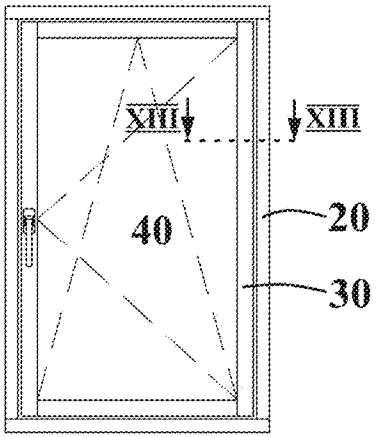
FIG. 13 shows a front schematic view of a window/shutter/door for outdoor settings, object of the present invention, at the upright of the movable wing hinged to the upright of the fixed framework, only for the purpose of indicating the position of a section trace XIII-XIII of the uprights of the window/shutter/door.
Figure 18:
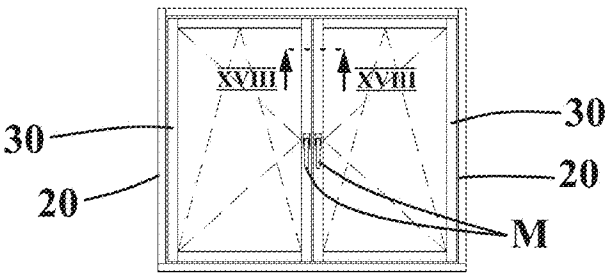
FIG. 18 shows a front schematic view of a window/shutter/door for outdoor settings, object of the present invention, comprising two side-by-side movable wings with an upright of the fixed framework interposed, only for the purpose of indicating the position of a section trace XVIII-XVIII of the uprights of the window/shutter/door.
Figure 19:
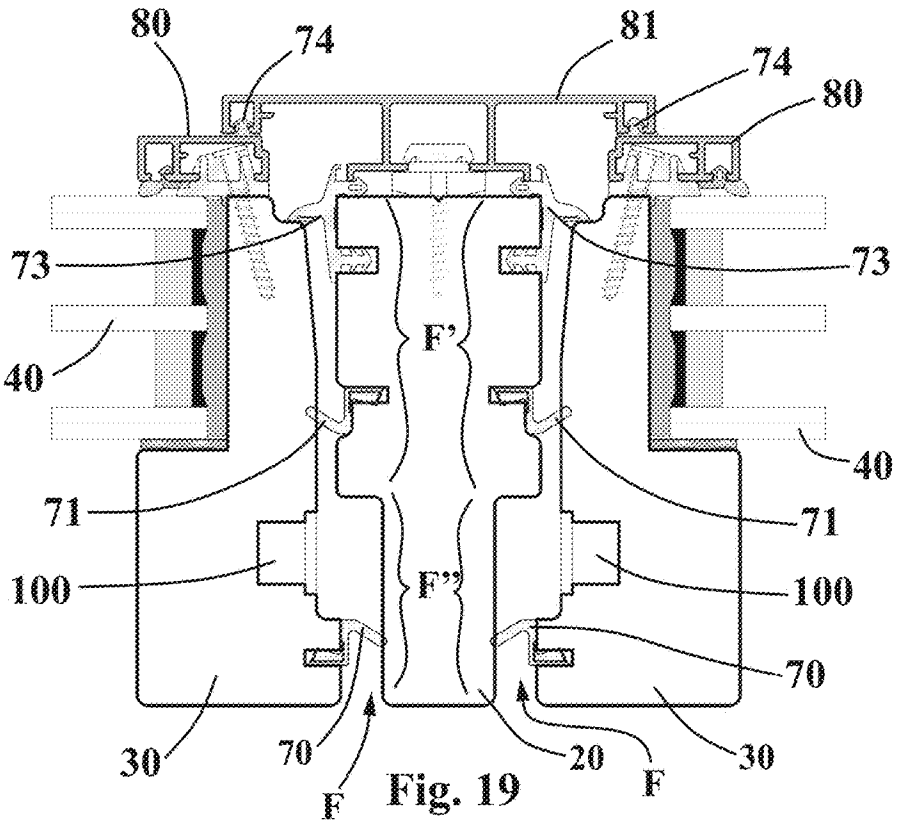
FIG. 19 shows a sectional view carried out along the trace XVIII-XVIII of FIG. 18, of the two uprights of the two side-by-side movable wings of the window/shutter/door according to the invention.
Figure 16:
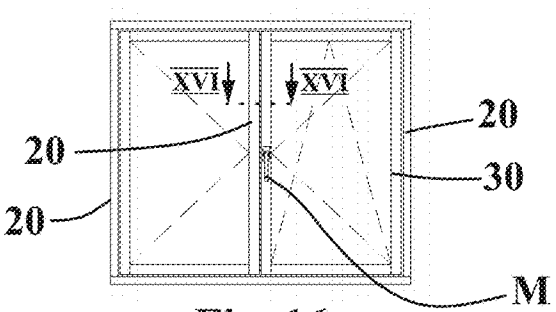
FIG. 16 shows a front schematic view of a window/shutter/door for outdoor settings, object of the present invention, comprising two side-by-side wings, of which one is fixed and one is movable, only for the purpose of indicating the position of a section trace XVI-XVI of the uprights of the window/shutter/door.
Figure 17:
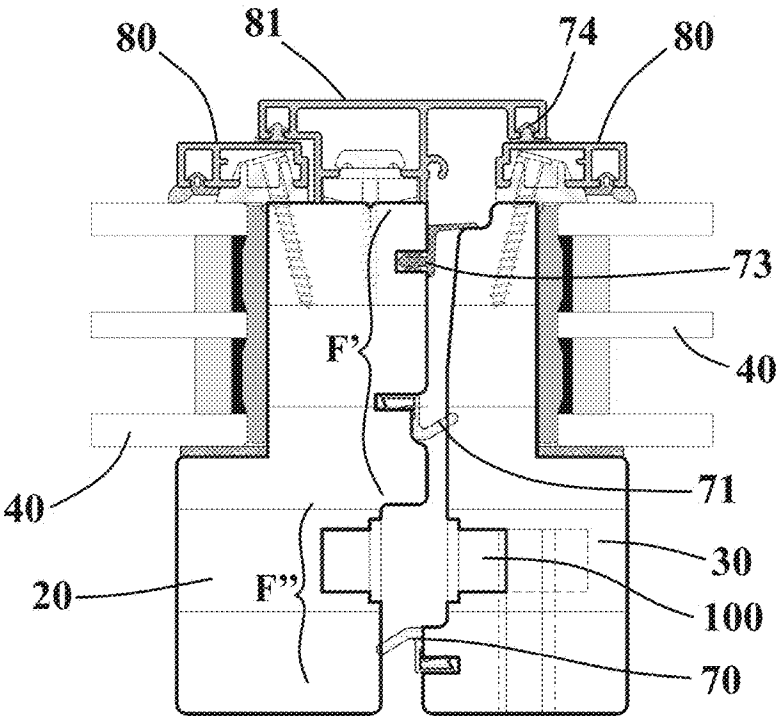
FIG. 17 shows a sectional view carried out along the trace XVI-XVI of FIG. 16, of the two uprights of the two side-by-side wings of the window/shutter/door according to the invention.

The window/shutter/door 1 also comprises a hinging system 6, e.g. formed by a pair of hinge 6 (or by multiple hinges), which rotatably connects the first support frame 30 of the movable wing 3 and the second support frame 20 of the fixed framework 2, and which allows moving the movable wing 3 between at least one open position B, in which the movable wing 3 frees the building wall opening S made on the structure of a building, and a closed position A, in which the movable wing 3 obstructs the building wall opening S itself. In FIGS. 14 and 15, the hinging system 6 is illustrated, comprising a hinge of retractable type, even if without departing from the protective scope of the present patent other well-known hinge types can also be provided for, like the retractable hinge, which are known the man skilled in the art and hence are not described in detail herein.

More in detail, the first support frame 30 of the movable wing 3 is provided with a first perimeter face 32, which is directed towards the interior of the support frame 30, and which carries the glass panel 40 mechanically associated therewith, and with a second perimeter face 33, which is directed towards the exterior of the support frame 30.

The first and the second perimeter faces 32, 33 of the first frame 30 of the movable wing 3 are extended between a first internal surface 34 and a first external surface 35 of the first frame 30, which are respectively directed towards the interior and exterior of a building when the window/shutter/door 1 is mounted on the load-bearing structure P.

In turn, the second support frame 20 of the fixed framework 2 is provided with a third perimeter face 22, which is intended to be fixed to the load-bearing structure P of a building at the opening S, and with a fourth perimeter face 23, when it is directed towards the movable wing 3, and is opposite the first perimeter face 33 of the first frame 30 of the movable wing 3, when this is in closed position A.

The third and the fourth perimeter face 22, 23 of the second frame 20 of the fixed framework 2 are extended between a second internal surface 24 and a second external surface 25 of the second frame 20, which are respectively directed towards the interior and exterior of a building when the window/shutter/door 1 is mounted on the load-bearing structure P.

Therefore, the second perimeter face 33 of the first frame 30 of the movable wing and the fourth perimeter face 23 of the second frame 20 of the fixed framework 2 define when the movable wing 3 is in closed position A, two opposite perimeter faces 33, 23 delimiting a slit F.

Such slit F is extended between an internal opening F1 and an external opening F2 respectively delimited between the first internal surfaces 34, 24 and the second external surfaces 35, 25 of the aforesaid first and second frame 30, 20.

The first internal opening advantageously has width comprised between 6 and 10 mm so as to allow the hinges, in particular of retractable type, to rotatably move the movable wing without interfering with the fixed framework 2, as illustrated in FIGS. 14 and 15. The abovementioned hinging system 6 is provided at two side-by-side and parallel uprights of the first and of the second frame 30, 20 (opposite the uprights provided with handle on the movable wing 3) and comprise in a per se conventional manner mechanical components which are fixed to the uprights and connection arms which are extended from such mechanical components to traverse the aforesaid slit F in order to rotatably connect together the movable wing 3 and the fixed framework 2.

The window/shutter/door 1 also comprises sealings 7, which are mechanically associated with one of the two perimeter faces 33, 23 of the two frames 30, 20 and are susceptible of sealing the movable wing 3 on the fixed framework 2 when the movable wing 3 is in closed position A.

In accordance with the idea underlying the present invention, the aforesaid sealings 7 comprise a first perimeter gasket 70 and a second perimeter gasket 71. The first perimeter gasket 70 is fixed to one of the two opposite perimeter faces 33, 23 of the two frames 30, 20 (and preferably to the first frame 30 of the movable wing 3), and is susceptible of acting against an opposite first flat section 23A of the perimeter face 23 of the opposite frame 20, 30 (and hence preferably belonging to the second frame 20 of the fixed framework 2), placed at the internal opening F1 of the slit F in order to conceal from view the hinging system 6 which comprises at least arms placed to traverse the slit F.

The second perimeter gasket 71 is fixed to one of the two opposite perimeter faces 33, 23 of the first and of the second frame 30, 20, and is susceptible of acting, when the movable wing 3 is in closed position A, against an opposite second flat section 33A of the perimeter face 33 of the opposite frame 20, 30, placed at an intermediate position between the internal opening F1 and the external opening F2 of the slit F.

More in detail, in accordance with the embodiments illustrated in the enclosed figures, the first perimeter gasket 70 is fixed at a third flat section 33B of the second perimeter face 33 of the first frame 30 of the movable wing 3 and comprises a first fixing foot 70A, inserted in a first groove 30A made on the second perimeter face 33 and a first seal element 70B projecting from the first groove 30A. Such first seal element 70B has an angle transverse section composed of a first abutment section 70B', placed adjacent in abutment against the second perimeter face 33 and fixed to the first fixing foot 70A and of a first sealing section 70B", angularly projecting from the first abutment section 70B' and extended through the slit F in order to act against the first section provided on the fourth perimeter face 23 of the fixed framework 2.

In addition and advantageously, still in accordance with the embodiments illustrated in the enclosed figures, the second perimeter gasket 71 is fixed at a fourth flat section 23B of the fourth perimeter face 23 of the second frame 20 of the fixed framework 2 and comprises a second fixing foot 71A, inserted in a second groove 20A made on the fourth perimeter face 23 and a second seal element 71B, which is fixed to the second foot 71B and projects from the second groove 20A. Such second seal element 71B has an angle transverse section composed of a second abutment section 71B', placed on the fourth perimeter face 23 and fixed to the second fixing foot 71A, and of a second sealing section 71B" angularly projecting from the second abutment section 71B' and extended through the slit F in order to act against the second flat section 33A provided on the second perimeter face 33 of the movable wing 3.

In accordance with the embodiments of FIGS. 3, 6, 7 and 9 and for the purposes of the present invention, the first section 23A of the fourth perimeter face 23 of the second frame 20 of the fixed framework 2 must be intended as also extended beyond the edge defined with its first internal surface 24, i.e. it must be intended as extended along the coplanar section of the internal edge of the plasterboard panel or of the plaster layer (or of their cover profile) or of the coating profile which continue the surface of the actual fourth perimeter face 23.

Figures 2, 3, 4:
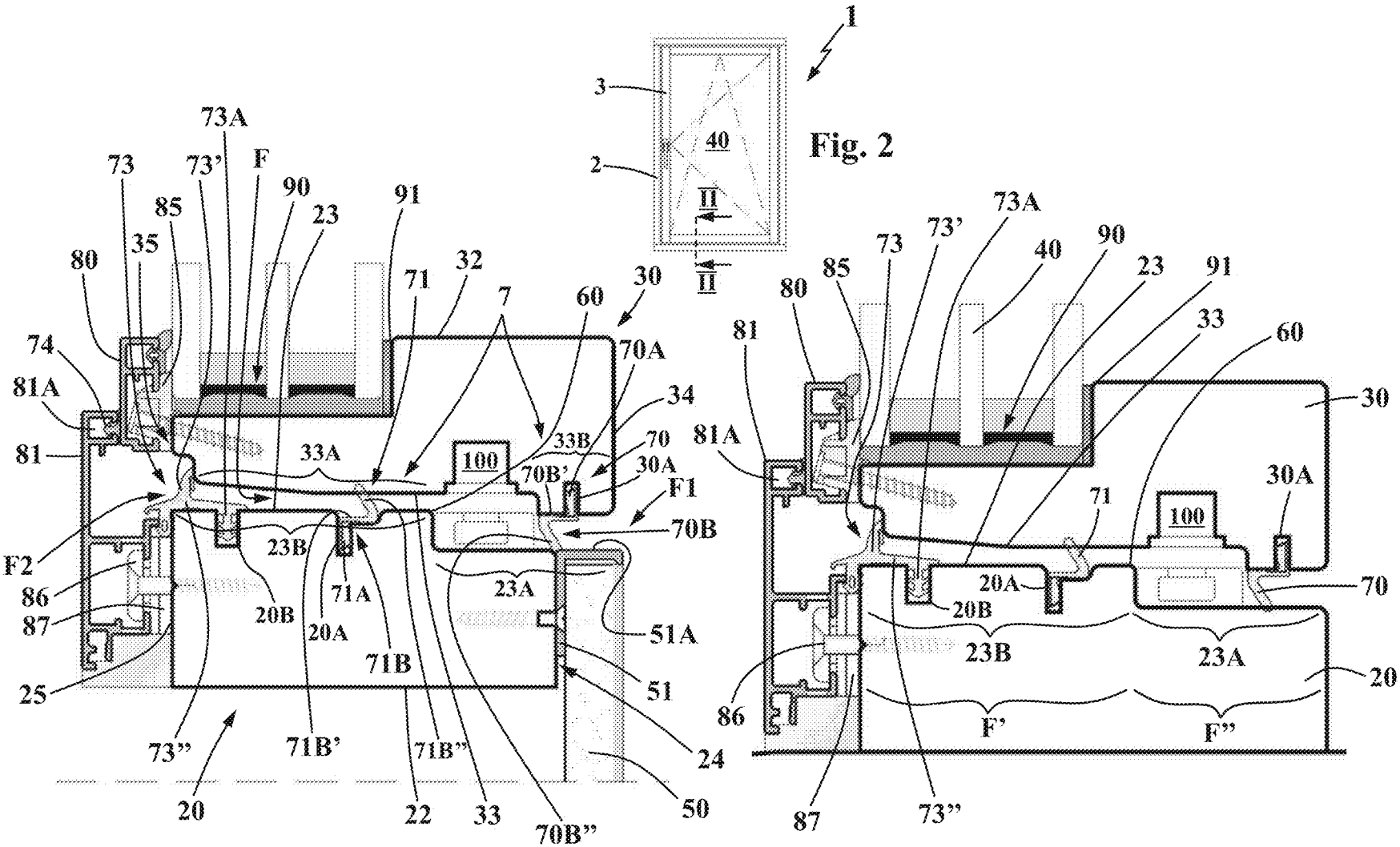
FIG. 2 shows a front schematic view of a window/shutter/door for outdoor settings, object of the present invention, only for the purpose of indicating the position of a section trace II-II of the crosspieces of the window/shutter/door.
FIG. 3 shows a sectional view carried out along the trace II-II of FIG. 2, of a crosspiece of the fixed framework and of a crosspiece of the movable wing of the window/shutter/door for outdoor settings illustrated in FIG. 1, with the fixed framework flush with the internal walling and with a plasterboard covering panel flush with the internal face of the building.
FIG. 4 shows the same sectional view of FIG. 3 in accordance with an embodiment variant in which the fixed framework is laid at the center of the walling.
Figure 6:
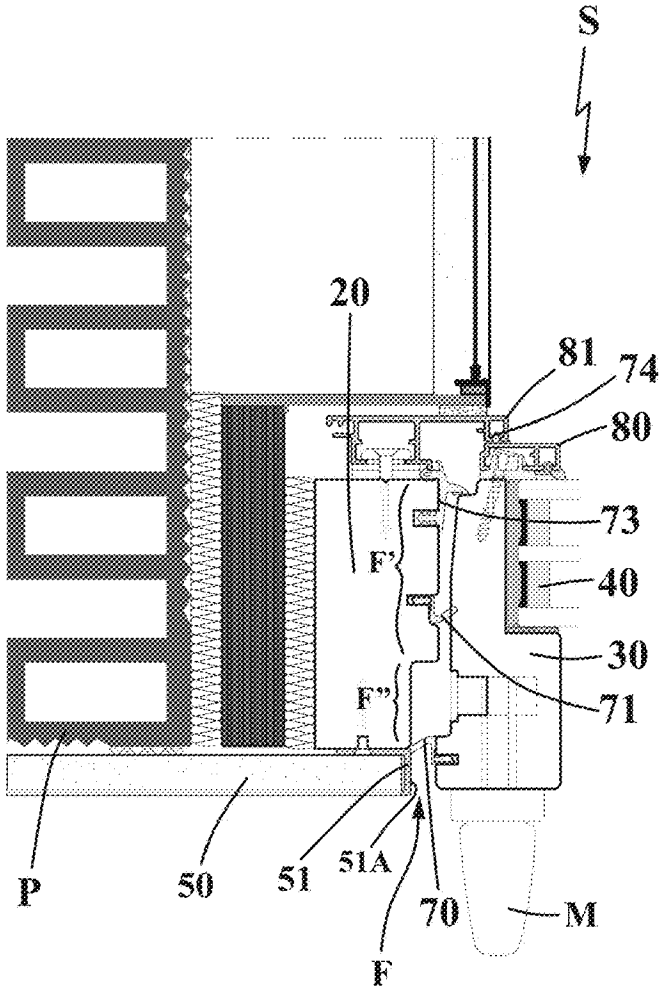
FIG. 6 shows a sectional view carried out along the trace V-V of FIG. 5, of an upright of the fixed framework and of an upright of the movable wing of the window/shutter/door for outdoor settings illustrated in FIG. 1, with the fixed framework flush with the walling and with a plasterboard covering panel placed flush with the internal face of the building.
Figure 5:
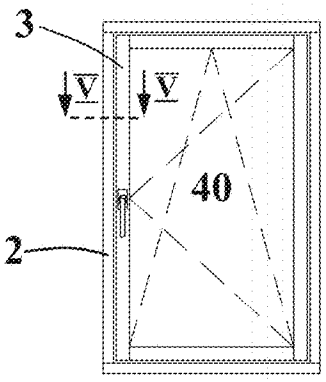
FIG. 5 shows a front schematic view of a window/shutter/door for outdoor settings, object of the present invention, only for the purpose of indicating the position of a section trace V-V of the uprights of the window/shutter/door.

More in detail, in accordance with the application mode of FIGS. 3 and 6, the fixed framework 2 is flush with the walling and a plasterboard covering panel 50 is provided which is placed flush with the internal face of the building. The plasterboard panel 50 is advantageously preferably covered with an angular profile 51 and, for the purposes of the present invention, it must be intended to define with its edge 51A a final part of the first section 23A of the fourth perimeter face 23 of the second frame 20.

Figure 7:
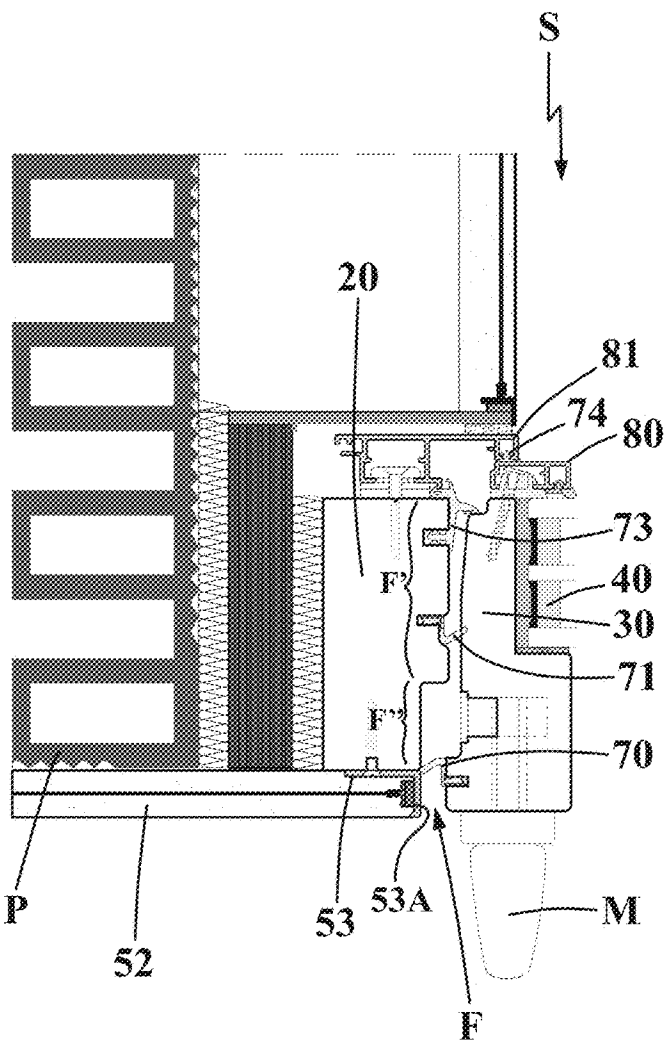
FIG. 7 shows a variant of the preceding view in which the fixed framework is flush with the internal walling and with a layer of covering plaster placed flush with the internal face of the building.

In accordance with the application mode of FIG. 7, the fixed framework 2 is flush with the internal walling P and a plaster covering layer 52 is provided placed flush with the internal face of the building. The plaster layer 52 is preferably covered with an angular profile 53 and, for the purposes of the present invention, it must be intended to define—with its edge 53A—a final part of the first section 23A of the fourth perimeter face 23 of the second frame 20.

Figure 9:
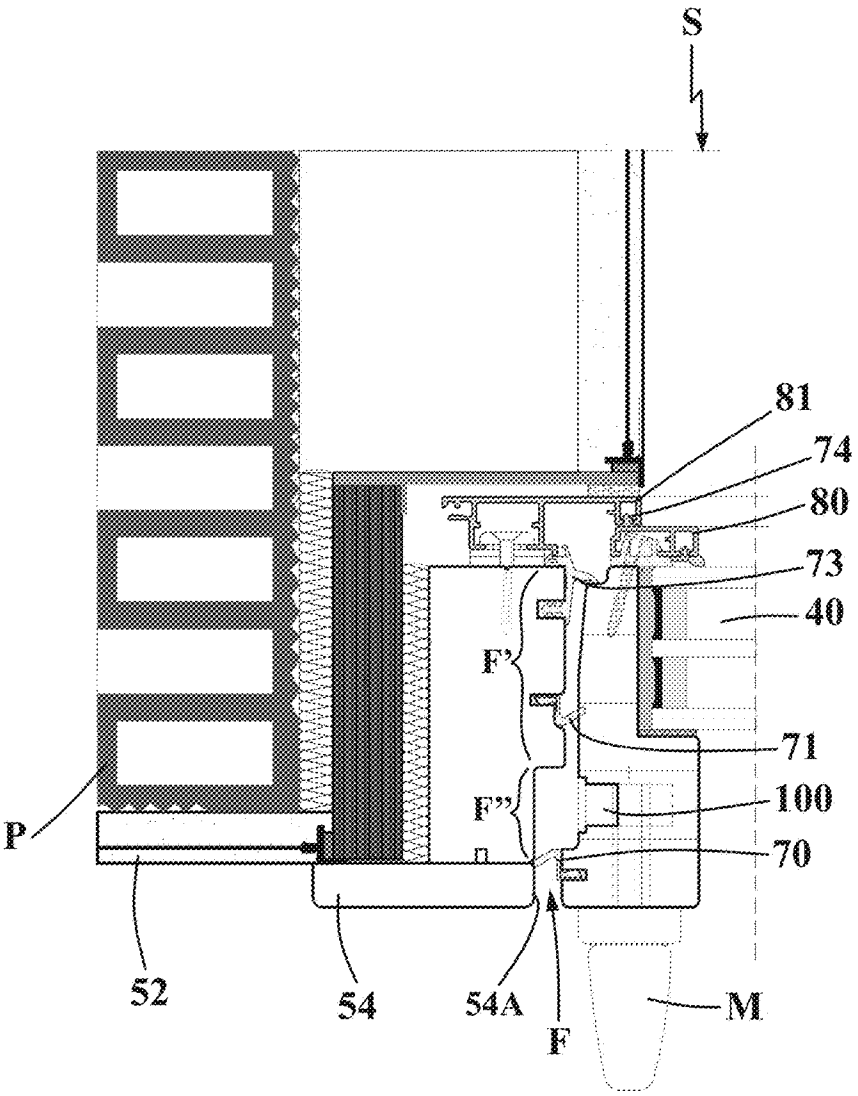
FIG. 9 shows a variant of the preceding view in which the fixed framework is flush with the internal face of the walling and with an internal covering profile to cover the framework and the edge of the internal face of the walling of the building.
Figure 8:
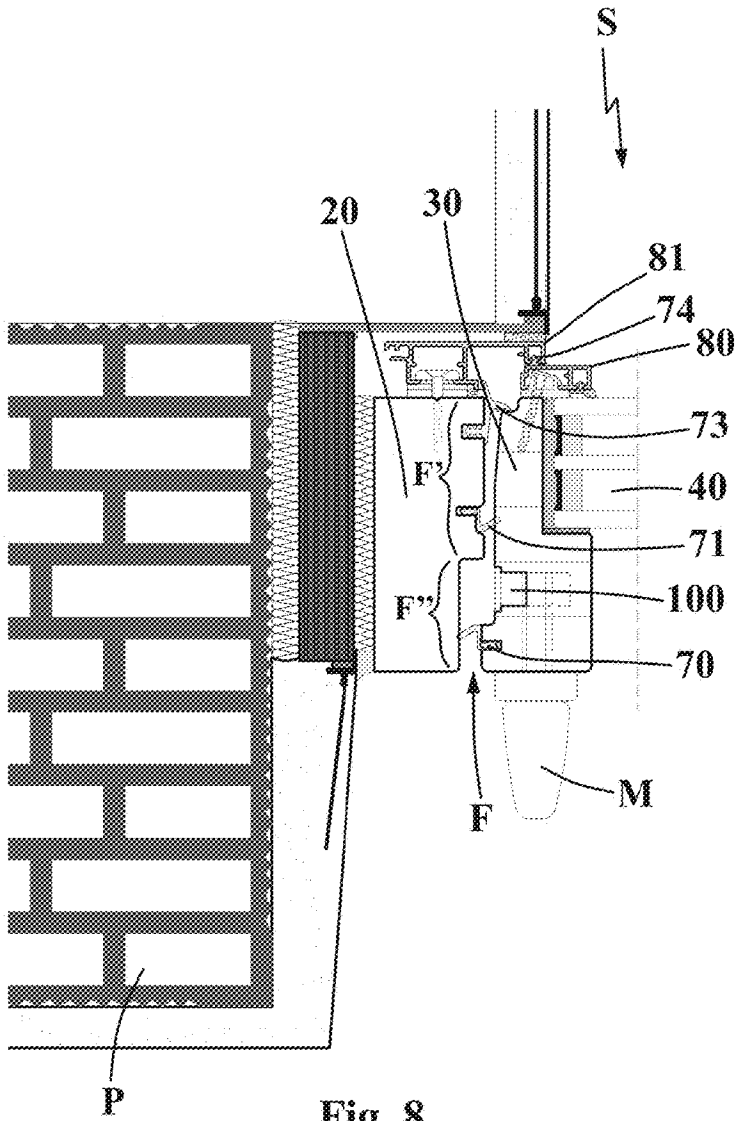
FIG. 8 shows a variant of the preceding view in which the fixed framework is placed at the center of the walling.
Figure 10:
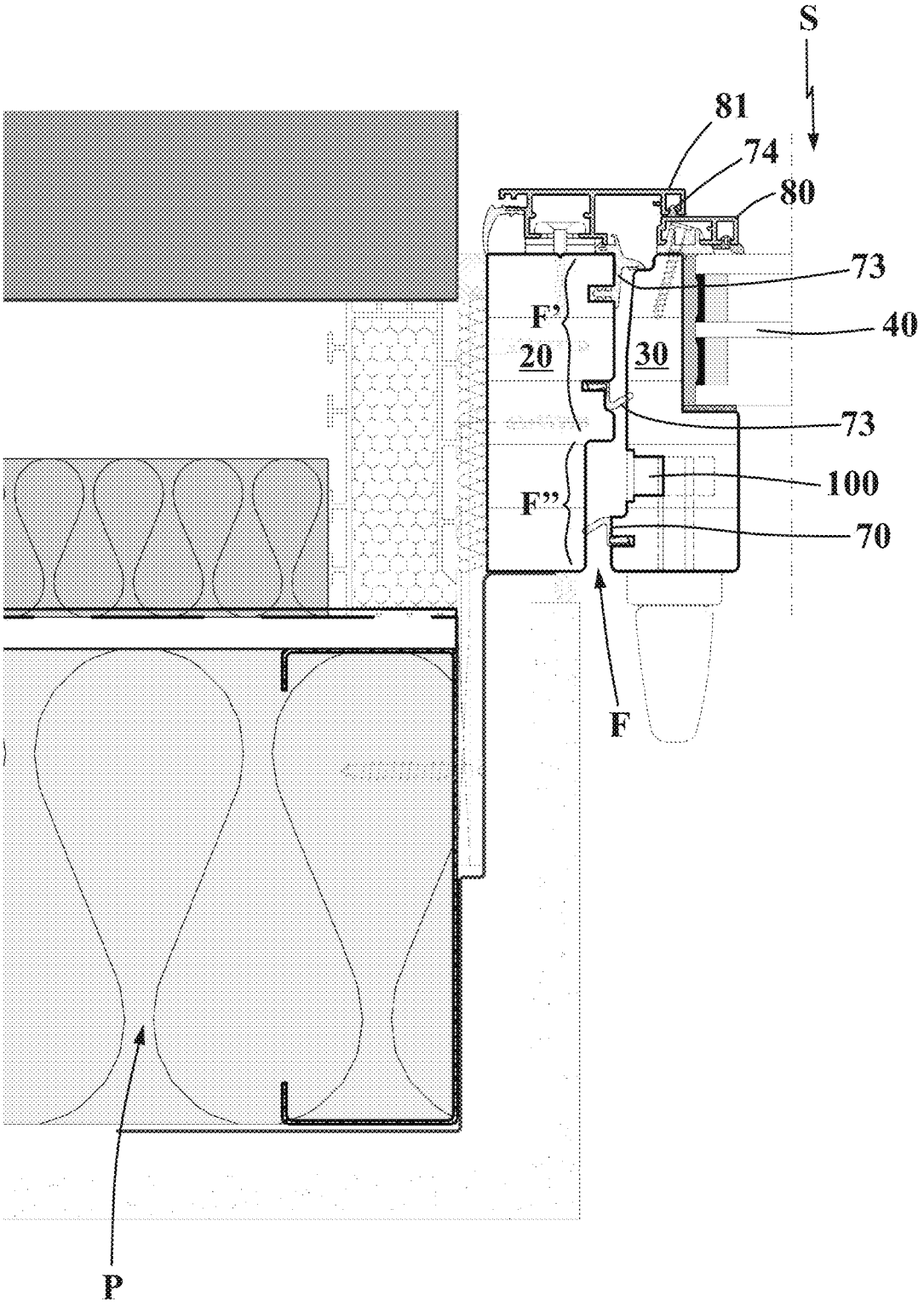
FIG. 10 shows a variant of the preceding view in which the window/shutter/door is mounted on a load-bearing structure of type with SFS metal framework.

In accordance with the application mode of FIG. 9, the fixed framework 2 projecting from the walling is flush with a plaster covering layer 52 placed flush with the internal face of the building. A covering profile 54, for example made of wood of the same material as the movable wing 3, is placed as a bridge-like cover of the junction between the plaster layer 52 and the second frame 20 of the fixed framework 2 (e.g. covering a wood counter-framework for fixing the fixed framework 2 to the walling P), passing above the edge of the plaster layer 52. For the purpose of the present invention, it must be intended that covering profile 54 defines, with its edge 54A, a final part of the first section 23A of the perimeter face 23 of the second frame 20.

In this manner, also the first gasket 70 is susceptible of acting against the opposite first section 23A of the fourth perimeter face 23 of the second frame 20 of the fixed framework, which can be intended as flat, like the second section 33A in order to allow the sealing section 70B" of the first gasket 70 along with the sealing section 71B" of the second gasket 71 to act sealingly, elastically bending in abutment against a flat surface with the passage of the wing from the open position B to the closed position A.

In accordance with the application modes of FIGS. 4, 8, 10, 12, 14, 15, 17, 19, 21, 23 the fixed framework 2 is extended with its first section 23A of the fourth perimeter face 23 of the second frame 20 up to the first internal opening F1, in particular parallel to the third flat section 33B of the second perimeter face 33 of the first frame 30 of the movable wing 3, so as to receive directly thereon the sealing section 70B" of the first gasket 70.

Advantageously the two gaskets 70 and 71 are shaped in an equivalent or substantially equivalent manner and they are both preferably made of polyurethane foam with, advantageously, thermal conductivity on the order of 0.041 W/mK at 0° C. Otherwise the gaskets can for example be made of epdm or of another similar material.

Preferably, the second sealing section 71B" of the second perimeter gasket 71 is more compressed by the second perimeter face 33 of the movable wing 3, when the latter is in closed position, than the first sealing section 70B" of the first perimeter gasket is compressed by the fourth perimeter face 23 of the fixed framework 2.

Advantageously, the first seal element 71B of the first perimeter gasket 70 has the concavity of its angled shape directed towards the interior of the building, or substantially directed towards the internal opening F1 of the slit F.

In turn and preferably, the second seal element 70B of the second perimeter gasket 71 has the concavity of the angle directed towards the exterior of the building, i.e. substantially directed towards the external opening F2 of the slit F.

Preferably, the second perimeter gasket 71 has the second seal element 71B having the second abutment section 71B' placed within a perimeter depression 230.

In accordance with the embodiment illustrated in the enclosed figures, the fixed framework 2 is shaped in a manner such that the first flat section 23A and the fourth flat section 23B of the fourth perimeter face 23 of the second frame 20 are separated by a first step 60, which defines a narrow section F' of the slit F towards the external opening F2 and a widened section F" of the slit F towards the internal opening F1.

The second flat section 33A and the third flat section 33B of the second perimeter face 33 of the first frame 30 of the movable wing 3 are separated from each other by a shaped seat 100 for containing the hinging system 6 as well as the hardware 200 necessary for closing the movable wing 3 on the fixed framework 2. Such hardware 200 is well known to the man skilled in the art and thus it will not be described in detail herein. It can for example comprise a single bolt mounted on the upright of the frame 30 of the movable wing 3 carrying the handle M associated therewith or it can provide a set of perimeter rods which are extended in such shaped seat 100 along the entire perimeter of the frame 30 of the movable wing 3.

Such shaped seat 100 of the second perimeter face 33 of the first frame 30 of the movable wing 3 is advantageously opposite the widened section F" of the slit F in order to house the hinging system 6 or even the hardware 200 in a facilitated manner.

Advantageously, the sealings 7 comprise a third perimeter gasket 73, which is fixed to the fourth perimeter face 23 of the second frame 20 of the fixed framework 2 at the external opening F2 of the slit F. Such third gasket 73 comprises a portion 73' projecting from a base 73" fixed to the fourth perimeter face 23 by means of at least one foot 73A which is inserted in a corresponding third groove 20B and is susceptible of receiving in abutment, with the movable wing in closed position A, the external surface 35 of the first frame 30 of the movable wing 3.

In accordance with the preferred embodiment illustrated in the enclosed figures, the window/shutter/door 1 comprises a first protection framework 80, fixed to the first external surface 35 of the first frame 30 of the movable wing 3, and a second protection framework 81 fixed to the second external surface 25 of the second frame 20 of the fixed framework 2.

Advantageously, in accordance with the examples of the enclosed figures, the first protection framework 80 is engaged with its first gripping ribs to first teeth of the first retention clips 85 fixed to the first external surface 35 of the first frame 30 by means of the first screws and the second protection framework 81 is engaged with its second gripping ribs in slits made in second retention clips 86, which are integral with a longitudinal plate 87 which in turn is fixed with the second screws to the second frame 20 of the fixed framework 2.

The sealings 7 comprise a fourth gasket 74 interposed between the first and the second protection framework 80, 81 when the movable wing is in closed position. The aforesaid fourth gasket 74 is advantageously mounted in a groove 81A made on the second protection framework 81 at a section surmounting the first protection framework 80 and is directed towards the interior of the building.

The first perimeter face 32 of the movable wing 3 is provided with a perimeter seat 90 for containing the glass panel 40, and is delimited by a second step 91 and by the first protection framework 80; the latter contributes to retaining the glass sealed by means of gluing in said perimeter seat 90. The glass panel 40 can comprise one, two or three parallel glass panes separated by respective double glazing.

Figure 21:
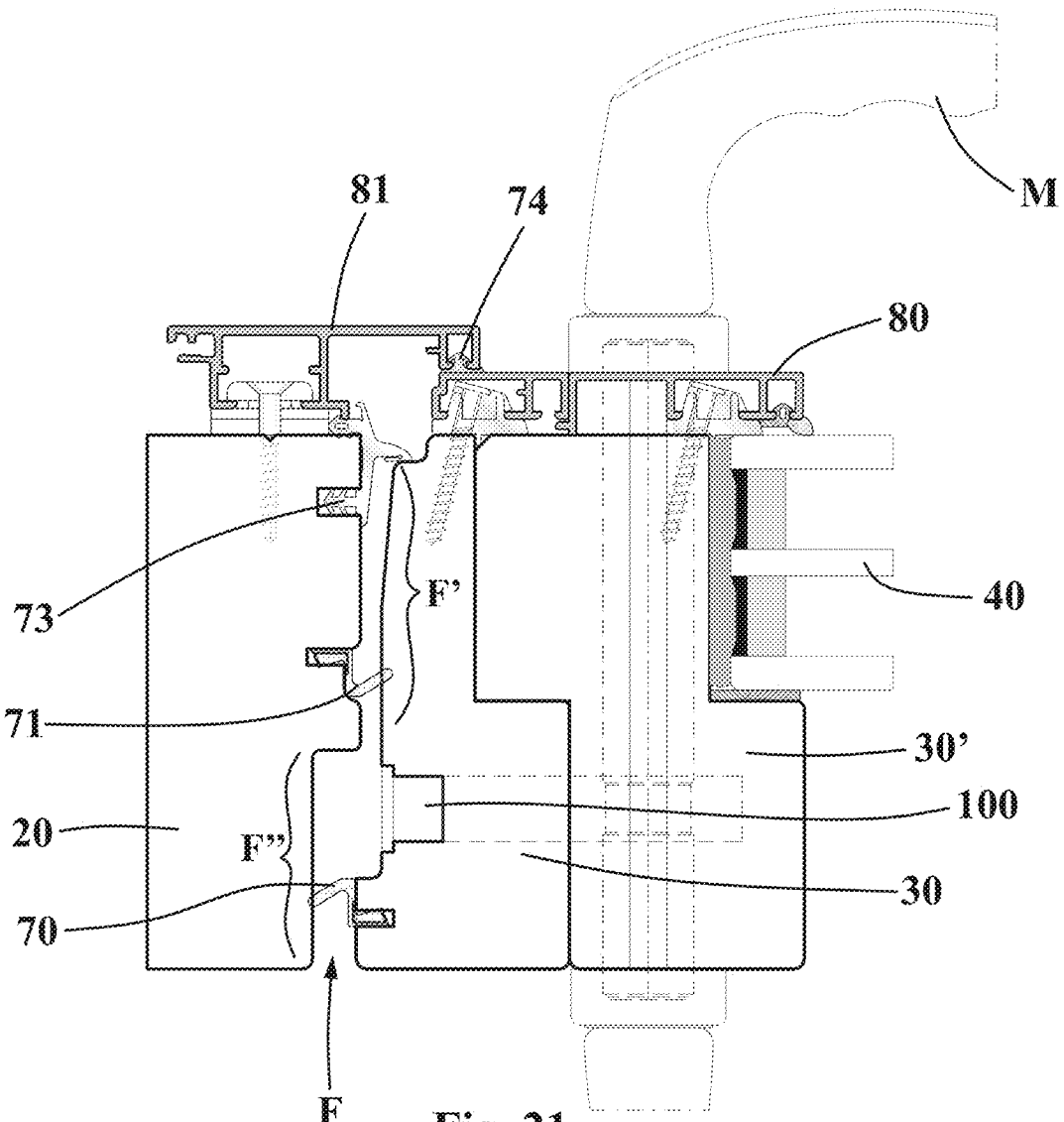
FIG. 21 shows a sectional view carried out along the trace XX-XX of FIG. 20, with a dashed line indicating the hardware means connected to the handles for the opening and closing of the wing of a French window/door.
Figure 20:
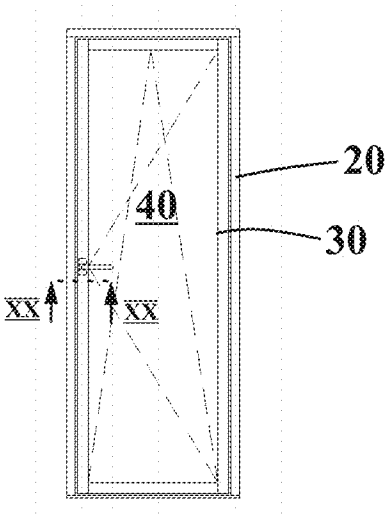
FIG. 20 shows a front schematic view of a window/shutter/door for outdoor settings, object of the present invention, comprising a French window/door wing with two opening handles, only for the purpose of indicating the position of a section trace XX-XX of the uprights of the window/shutter/door.

In FIGS. 20 and 21, a movable wing 3 is illustrated which is provided with an additional framework 30' with two opening handles M and the hardware means 200 indicated with a dashed line, such means connected to the handles M for the opening and closing of the movable wing 3.

In FIGS. 22 and 23, a fixed wing 30" is illustrated, which is rendered fixed through the use of locking means 110 inserted in the shaped seat 100 and provided with screws gripping on both frames 20 and 30 in order to rigidly lock the wing 30' to the fixed framework 2. Such solution is indicated in order to underline the flexibility of the window/shutter/door according to the finding, which allows easily transforming a movable wing 30 into a fixed wing 30'.

Advantageously, due to the present invention, the thickness D of the movable wing measured on its first internal surface 34 is quite limited and advantageously comprised between 35 and 50 mm and is preferably about 40 mm, allowing optimally meeting the requirements of the market of minimizing the wing sizes, maintaining a high sealing against noise and against weathering agents.

Figure 12:
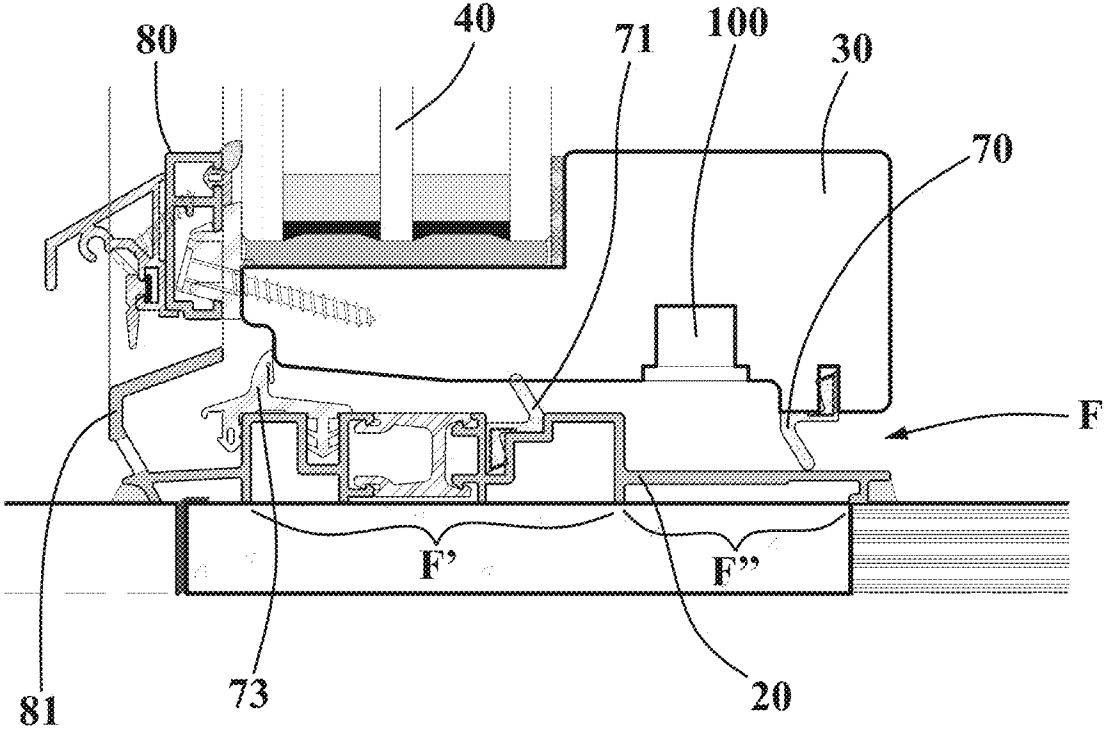
FIG. 12 shows a sectional view carried out along the trace XI-XI of FIG. 11, of the crosspieces of the fixed framework and of the movable wing of the window/shutter/door at a threshold/entrance thereof fixed to the floor.
Figure 11:
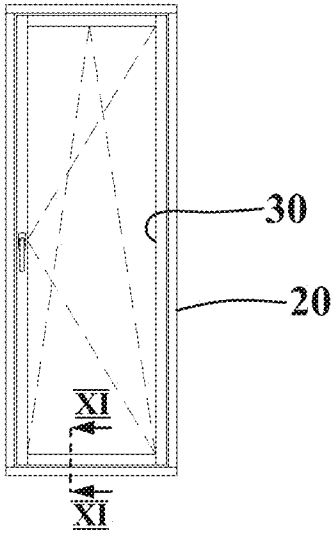
FIG. 11 shows a front schematic view of a window/shutter/door for outdoor settings, object of the present invention, only for the purpose of indicating the position of a section trace XI-XI of the crosspieces of the threshold/entrance of the window/shutter/door.

In FIG. 12, the section of the threshold/entrance of a wing of a French window/door is illustrated, in which the second frame 20 of the fixed framework 2 is made with a metallic profile having an intermediate portion made of plastic with thermal insulation function. Such metallic profile receives, in abutment against its first flat section 23A of its fourth perimeter face 23, the first perimeter gasket 70 mounted on the opposite third flat section 33B of the second perimeter face 33 opposite the wing 3. As indicated above for the preceding examples of profiles of the framework, preferably made of wood, also such metallic profile of the fixed framework 2 of the threshold/entrance is provided at its fourth flat section 23B of its fourth perimeter face 23 with a second groove 20A in which the second perimeter gasket 71 is inserted.

The remaining profiles of the second frame 20 of the fixed framework 2 are advantageously made in the normal manner, as in the other above-described examples, i.e. preferably made of wood.

The window/shutter/door thus conceived therefore attains the pre-established objects. It is in any case clear that modifications can be made to the window/shutter/door for outdoor settings described up to now, without departing from the protective scope of the present patent.

In addition, all the details can be substituted by technically equivalent elements and the sizes, shapes and materials used can be of any type depending on the requirements.

The invention claimed is:

1. A window or door for outdoor settings, which is intended to be mounted in an opening of a building in order to separate an internal environment from an external environment, said window or door comprising:

a movable wing, which is provided with a first support frame and with at least one glass panel perimetrically fixed to said first support frame;

a fixed framework, which supports said movable wing, and comprises at least one second support frame;

a hinging system, which rotatably connects the first support frame of said movable wing and the second support frame of said fixed framework between at least one closed position and at least one open position towards the internal environment of the building;

wherein the first support frame of said movable wing is made of wood and has:

a first perimeter face, which is directed towards an interior of said first support frame, and carries said at least one glass panel mechanically associated therewith;

a second perimeter face, which is directed towards an exterior of said first support frame;

wherein said first perimeter face and said second perimeter face are extended between a first internal surface and a first external surface of said first support frame, wherein said first internal surface and said first external surface are susceptible of being directed towards, respectively, the interior environment and exterior environment of the building;

wherein the second support frame of said fixed framework has:

a third perimeter face susceptible of being fixed to a load-bearing structure of the building at the opening, a fourth perimeter face, which is directed towards said movable wing, and is susceptible of being opposite to the second perimeter face of the first support frame of said movable wing with said movable wing in the closed position;

wherein said third perimeter face and said fourth perimeter face are extended between a second internal surface and a second external surface of said second support frame, wherein said second internal surface and said second external surface are susceptible of being directed towards, respectively, the interior environment and exterior environment of the building;

wherein the second perimeter face of the first support frame of said movable wing and the fourth perimeter face of the second support frame of said fixed framework define, with said movable wing in the closed position, two opposite perimeter faces delimiting a slit which is extended between an internal opening and an external opening, wherein said internal opening is delimited between said first internal surface and said second internal surface, and said external opening is delimited between said first external surface and said second external surface;

said window or door further comprising sealings mechanically associated with one of said two opposite perimeter faces;

wherein said sealings comprise:

at least one first perimeter gasket, which is fixed to one of said two opposite perimeter faces and is susceptible of acting, with said movable wing in the closed position, against an opposite first flat section of the other of said two opposite perimeter faces, placed at the internal opening of said slit in order to conceal from view said hinging system placed to traverse said slit;

at least one second perimeter gasket, which is fixed to one of said two opposite perimeter faces and is susceptible of acting, with said movable wing in the closed position, against an opposite second flat section of the other of said two opposite perimeter faces, placed at an intermediate position between the internal opening and the external opening of said slit;

wherein the window or door further comprises a first protection framework fixed to the first external surface of the first support frame of said movable wing and a second protection framework fixed to the second external surface of the second support frame of said fixed framework; said sealings comprising a gasket interposed between said first protection framework and said second protection framework with said movable wing in the closed position;

wherein the second perimeter face of the first support frame of said movable wing is provided with a shaped seat for containing at least part of said hinging system;

wherein the fourth perimeter face of the second support frame of said fixed framework is provided with a first step, which defines a narrow section of said slit towards said external opening, and a widened section of said slit towards said internal opening; wherein said at least one second perimeter gasket is positioned in said narrow section and said first flat section extends from said first step to said internal opening;

wherein, with said movable wing in the closed position, the shaped seat of the second perimeter face of the first support frame of said movable wing is opposite the widened section of said slit in order to house at least said hinging system;

wherein, with said movable wing in the closed position, said first step faces said at least one first perimeter gasket and has a top edge that is higher than an edge of said internal opening defined by said second internal surface;

wherein, with said movable wing in the closed position, said hinging system is positioned between said first step and said at least one first perimeter gasket;

wherein said hinging system abuts against said first step.

2. The window or door of claim 1, wherein said at least one first perimeter gasket is fixed at a third flat section of the second perimeter face of the first support frame of said movable wing and comprises:

a first fixing foot inserted in a first groove made on said second perimeter face, and a first seal element projecting from said first groove, having angle transverse section obtained with a first abutment section, placed on said second perimeter face and fixed to said first fixing foot, and with a first sealing section, angularly projecting from the first abutment section and extended through said slit in order to act against the first flat section provided on said fourth perimeter face of said fixed framework.

3. The window or door of claim 2, wherein the first seal element of said at least one first perimeter gasket has concavity of the angle directed towards the internal opening of said slit.

4. The window or door of claim 2, wherein the second flat section and the third flat section of the second perimeter face of the first support frame of said movable wing are separated from each other by said shaped seat.

5. The window or door of claim 1, wherein said at least one second perimeter gasket is fixed at a fourth flat section of the fourth perimeter face of the second support frame of said fixed framework, and comprises a second fixing foot inserted in a second groove made on said fourth perimeter face, and a second seal element fixed to said second fixing foot, projecting from said second groove, having angle transverse section obtained with a second abutment section placed on said fourth perimeter face and fixed to said second fixing foot, and with a second sealing section angularly projecting from the second abutment section and extended through said slit in order to act against the second flat section provided on said second perimeter face of said movable wing.

6. The window or door of claim 5, wherein said second perimeter gasket has the second seal element having the second abutment section placed within a perimeter depression.

7. The window or door of claim 5, wherein the second seal element of said at least one second perimeter gasket has concavity of the angle directed towards the external opening of said slit.

8. The window or door of claim 5, wherein the first flat section and the fourth flat section of the fourth perimeter face of the second support frame of said fixed framework are separated by said first step.

9. The window or door of claim 2, wherein said second perimeter gasket is fixed at a fourth flat section of the fourth perimeter face of the second support frame of said fixed framework, and comprises a second fixing foot inserted in a second groove made on said fourth perimeter face, and a second seal element fixed to said second fixing foot, projecting from said second groove, having angle transverse section obtained with a second abutment section placed on said fourth perimeter face and fixed to said second fixing foot, and with a second sealing section angularly projecting from the second abutment section and extended through said slit in order to act against the second flat section provided on said second perimeter face of said movable wing;

wherein the second sealing section of said at least one second perimeter gasket is more compressed by the second perimeter face of said movable wing, when said movable wing is in closed position, than the first sealing section of the at least one first perimeter gasket is compressed by the fourth perimeter face of said fixed framework.

10. The window or door of claim 1, wherein said sealings comprise a third perimeter gasket fixed to the fourth perimeter face of the second support frame of said fixed framework at the external opening of said slit, said third gasket comprising a portion projecting from a base fixed to said fourth perimeter face and susceptible of receiving in abutment, with said movable wing in the closed position, the external surface of the first frame of said movable wing.

11. The window or door of claim 1, wherein the first perimeter face of said movable wing is provided with a perimeter seat for containing said at least one glass panel, said perimeter seat being delimited by a second step and by said first protection framework.

* * * * *